US006598685B1

(12) United States Patent
Mashburn

(10) Patent No.: US 6,598,685 B1
(45) Date of Patent: Jul. 29, 2003

(54) DRILLING FLUID SCREEN AND METHOD

(76) Inventor: Benny Donald Mashburn, 103 Turn Row, Lafayette, LA (US) 70508

( * ) Notice: Subject to any disclaimer, the term of this patent is extended or adjusted under 35 U.S.C. 154(b) by 0 days.

(21) Appl. No.: 10/076,921

(22) Filed: Feb. 14, 2002

(51) Int. Cl.[7] ..... E21B 43/08; E21B 43/10
(52) U.S. Cl. ..... 175/57; 166/227; 175/314
(58) Field of Search ..... 175/314, 57; 166/227; 210/452, 448

(56) References Cited

U.S. PATENT DOCUMENTS

| | | | | | |
|---|---|---|---|---|---|
| 1,135,809 | A | * | 4/1915 | Jone | 166/195 |
| 3,302,722 | A | * | 2/1967 | Madeley, Sr. | 166/157 |
| 4,495,073 | A | | 1/1985 | Beimgraben | 210/448 |
| 5,377,750 | A | * | 1/1995 | Arterbury et al. | 166/205 |
| 5,762,137 | A | * | 6/1998 | Ross et al. | 166/205 |
| 6,155,342 | A | * | 12/2000 | Oneal et al. | 166/51 |
| 6,296,055 | B1 | * | 10/2001 | Taylor | 166/205 |

* cited by examiner

*Primary Examiner*—Hoang Dang
(74) *Attorney, Agent, or Firm*—Domingue & Waddell, PLC

(57) ABSTRACT

An apparatus for filtering a drilling fluid. The apparatus comprises a cylindrical flange member having a first and second passage and a cylindrical sleeve having an internal fishing neck. An attachment pin attaches the flange member to the cylindrical sleeve. The apparatus further comprises a screen member attached to the cylindrical sleeve. In one embodiment, the first and second passage are disposed off-centered so that four bore holes are created. The attachment pin cooperates with a groove formed on the sleeve's outer diameter surface. The apparatus may further include a pulling tool. The pulling tool contains a plurality of dog members disposed about a mandrel, and a spring that urges the dog members into engagement with a protuberance on the mandrel. The apparatus further comprises a shear pin attaching the dog members to the mandrel and wherein the shear pin is disposed within a slot so that the dog members can move axially relative to the mandrel. In one embodiment, the screen member is a cylindrical ribbed body. A method of cleaning a drilling fluid is also disclosed.

20 Claims, 13 Drawing Sheets

DRILLING FLUID SCREEN AND METHOD

BACKGROUND OF THE INVENTION

This invention relates to an apparatus for filtering a well bore fluid. More particularly, but not by way of limitation, this invention relates to an apparatus positioned in a tubular member in order to filter a well bore fluid. The invention also describes the method of filtering the well bore fluid with the apparatus.

The use of drilling fluids for the drilling of oil and gas wells is well known. The drilling fluid serves many purposes, including suppression of reservoir pressure, lubrication of the drill pipe, and cooling of the bottom hole assemblies, etc. The bottom hole assemblies may contain individual components such as bits, stabilizers, measurement while drilling tools, etc. Many times, the bottom hole assemblies contain electronic sections such as microprocessors that are used to collect and/or transmit data collected by sensors placed in the bottom hole assemblies.

Drilling fluids may contain many different types of components such as mud, chemicals, drill cuttings, metal shavings, etc. The particle size of these various components vary from microns to inches. Additionally, rig crews may inadvertently drop tools, glooves, rags or other unwanted materials into the well bore. The unwanted and/or undesirable solids, hereinafter. referred to as debris, is highly harmful. For instance, the debris can cause failures in the electrical components of the bottom hole assemblies. Therefore, operators find it desirable to filter the drilling fluid of the debris.

Many methods of filtering well bore fluid exists. One present method includes placing a filter in the tubular members while the tubular members are being run into the well bore. The prior art devices presently available utilize a cylindrical screen that have an external fishing neck. However, these types of devices have many disadvantages. For instance, the openings contained in the top end have a limited flow through area. Additionally, the external fishing neck has an inherent weak point at the stem making it possible for the stem to break off while in the tubular members, which would be highly undesirable and/or dangerous, as those of ordinary skill in the art will recognize.

Therefore, there is a need for an apparatus for filtering a drilling fluid. There is also a need for a filtering device that can be retrieved from a well bore safely and quickly. Further, there is a need for a filtering device that efficiently filters the drilling fluid while still allowing maximum flow through capabilities. These needs, as well as many others, will be met by the invention herein disclosed.

SUMMARY OF THE INVENTION

A system for filtering a drilling fluid in a tubular string is disclosed. A first tubular member having a box end and a second tubular member having a pin end is provided. The box end is threadedly connected to the pin end, and wherein the connection forms a cavity. The connected tubular members have an internal bore therethrough.

The system comprises a cylindrical flange member having a first passage and a second passage, and wherein the cylindrical flange member is fitted into the cavity. The system further comprises a cylindrical sleeve having an internal bore, and wherein the internal bore contains a fishing neck. The cylindrical sleeve contains a first opened end and a second opened end. An attachment member that attaches the cylindrical flange member to the first opened end of the cylindrical sleeve is included.

The system further includes a screen member extending from the second opened end of the cylindrical sleeve, with the screen member having a plurality of openings. A pulling tool for engagement with the fishing neck is also included, with the pulling tool comprising: a mandrel with a first end and a second end; a plurality of dog members disposed about the mandrel; a spring urging the dog members into engagement with the mandrel's first end; and wherein the dog members have a shoulder that cooperates and engages with the fishing neck. The pulling tool may further comprise a shear pin attaching the dog members to the mandrel, and wherein the mandrel contains a slot, and wherein the shear pin is disposed within the slot so that the dog members can move axially relative to the mandrel.

In one embodiment, the first passage and the second passage are disposed off-centered so that the first passage includes a first bore hole and a second bore hole, and the second passage includes a third bore hole and a fourth bore hole and wherein the attachment member comprises a first shear pin through said first and second bore hole and a second shear pin through said third and fourth bore hole. The cylindrical flange member may contain a first sealing surface that cooperates with the cavity in order to seal the cylindrical flange member relative to the internal bore.

In one embodiment, the screen member is a cylindrical ribbed body. In another embodiment, the screen member is a cylindrical body having openings therein.

A method of cleaning a drilling fluid of debris within a plurality of tubular members is also disclosed. The tubular members are threadedly connected, and the plurality of tubular members include a first tubular member having a box end and a second tubular member having a pin end. The box is threadedly connected to the pin, and wherein the box and pin cooperate to form a cavity. The method comprises placing a screen apparatus within the first tubular member. The screen apparatus comprises: a cylindrical flange member, with the cylindrical flange member having a first and second passage, and wherein the cylindrical flange member is fitted into the cavity; a cylindrical sleeve having an internal bore that contains a fishing neck; and a screen member attached to the cylindrical sleeve.

The method further includes seating the cylindrical flange member within the cavity, and passing the drilling fluid through the internal bore. Next, the drilling fluid is flown through the screen member and debris is collected within the screen member. The method includes providing a pulling tool. The pulling tool contains: a mandrel with a first end and a second end; a plurality of dog members disposed about the mandrel; a spring urging the dog members into engagement with the mandrel's first end; and wherein the dog members have a shoulder that cooperates and engages with the fishing neck of the cylindrical sleeve.

The method further includes lowering the pulling tool into the tubular member and contacting the dog members with the cylindrical sleeve. The dog members are allowed to contract about the mandrel. The protuberance is allowed to pass the fishing neck, and the pulling tool is lowered. The dog members then are allowed to engage the shoulder of the fishing neck. Thereafter, the pulling tool may be raised.

The method further comprises shearing the first and second shear pin and releasing the cylindrical sleeve from the cylindrical flange. Next, the pulling tool is pulled with the attached screen member from the tubular member. The tubular members are pulled from the well bore, and the tubular members are threadedly disconnected. The cylindrical flange is retrieved.

Also disclosed is an apparatus for filtering a drilling fluid. The apparatus comprises a flange member having a first and second passage. A cylindrical sleeve having an internal bore is included, with the internal bore containing a fishing neck. The apparatus further includes means for attaching the flange member to the sleeve and a screen member attached at a second opened end of the sleeve. In one embodiment, the first passage and the second passage are offset from center so that four bore holes are formed. In the preferred embodiment, the attaching means includes a first shear pin through the first and second bore holes and cooperating with a groove on outer diameter of the cylindrical sleeve and a second shear pin through the third and fourth bore holes and cooperating with the groove on the outer diameter of the cylindrical sleeve. In one embodiment, the flange member has a first seating surface that cooperates with a cavity that is formed from the pin and box connection.

The apparatus may further include a pulling tool. The pulling tool includes a mandrel, a plurality of dog members disposed about the mandrel, and a spring urging the dog members into engagement with the mandrel's first end. The dog members will have a shoulder that cooperates and engages with the fishing neck of the sleeve.

An advantage of the present invention includes the filtering of the drilling fluid so that down hole tools are protected from debris. Another advantage is that the apparatus has a completely open top end for full flow of the fluid into the screen. Yet another advantage is that the embodiments disclose different types of screens, namely a ribbed screen, perforated openings, and/or wire mesh. Still yet another advantage is in the event that the filter is inadvertently left in the tubular string, the design allows for retrieve from the tubular string, with retrieval possible to many thousand of feet below the surface of the earth.

A feature of the present invention includes the screen has cylindrical walls. The screen has an open top end and a base with openings therein. Another feature is the flange that is connected via shear pins to the fishing neck. Yet another feature is use of a disclosed wire line pulling tool to retrieve the apparatus from the tubular string within a well bore. Still yet another feature includes the ability to pull significant forces via the wire line in order to retrieve the novel apparatus.

DETAILED DESCRIPTION OF THE PREFERRED EMBODIMENTS

Figure 1:
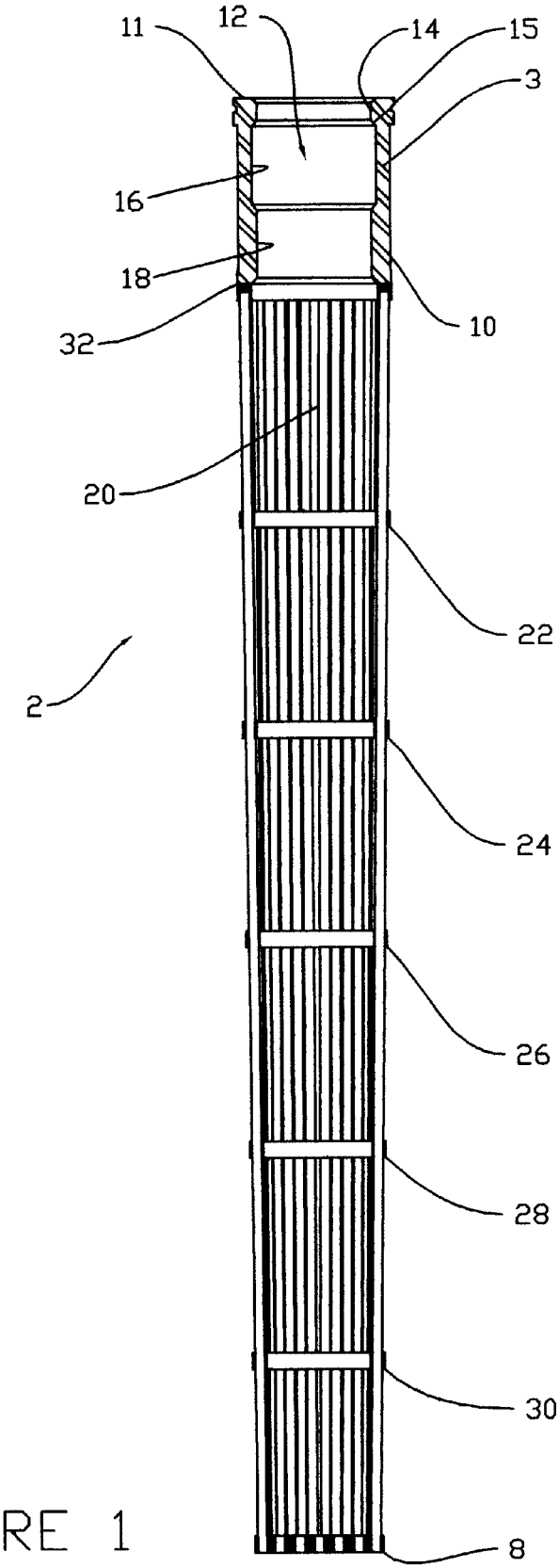
FIG. 1 is a cross-sectional plan view of the screen of the present invention.

Referring to FIG. 1, a cross-sectional plan view of the screen 2 of the present invention will now be described. The screen 2 includes an upper sleeve 3, with the screen 2 having a generally cylindrical body 6 that extends to the base 8. The upper sleeve 3 has an external outer diameter 10 that extends to the top radial surface 11. Extending radially inward is the internal bore, seen generally at 12. The internal bore 12 has a first internal bore surface 14, having a beveled shoulder 15, that extends to an increased internal bore surface 16 with the internal bore surface 16 being also referred to as the fishing neck 16. The fishing neck 16 extends to the smaller internal bore surface 18.

The upper sleeve 3 has extending therefrom a plurality of rods, with the rods seen generally at 20. The rods 20 form the cylindrical body 6. The rods 20 are spaced longitudinally in a general cylindrical fashion so that a screen is formed. The rods 20 act to sift out debris in the well bore fluid as will be more fully set out. The rods 20 are attached to the upper sleeve 3 via conventional means which in the preferred embodiment is welding. A plurality of cylindrical rings, namely ring 22, ring 24, ring 26, ring 28 and ring 30, are provided, with each individual ring having bored holes through which the rods are disposed there through. The rings 22, 24, 26, 28, and 30 act to keep the rods 20 evenly spaced through deployment and use. The rings may be welded to the rods in order to keep the rings in place.

As seen in FIG. 1, in the preferred embodiment, the screen 2, and in particular the rods 20 have a taper from the connection point at 32 to the base 8. The rods 20 may be welded to the sleeve 3 at 32. The taper generally allows for easier insertion into the tubular members and withdrawal from the tubular members. The base 8 contains, in the preferred embodiment, perforations for passage of the fluid while at the same time providing for the capture of solids within the fluid.

Figure 2A:
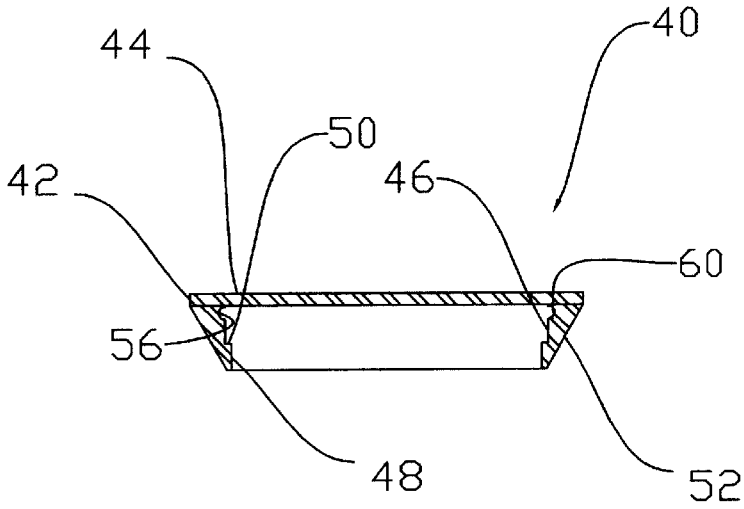
FIG. 2A is a plan view of the flange of the present invention.

Referring now to FIG. 2A, a plan view of the flange 40 of the present invention will now be described. It should be noted that like numbers appearing in the various figures refer to like components. The flange 40 is pinned to the upper sleeve 3, with the flange 40 being placed within a cavity formed in a pin and box connection as will be more fully described later. The flange 40 comprises a first outer diameter surface 42 that extends to the radially flat surface 44 which in turn extends to the first internal diameter surface 46 which in turn extends to the second internal diameter surface 48 of slightly smaller internal diameter so that a lip 50 is formed. The first outer diameter surface 42 also extends to the outer tapered surface 52, sometimes referred to as the seating surface 52 for seating within the cavity. FIG. 2A also depicts the passage 56 and passage 60 for placement of shear pin.

Figure 2B:
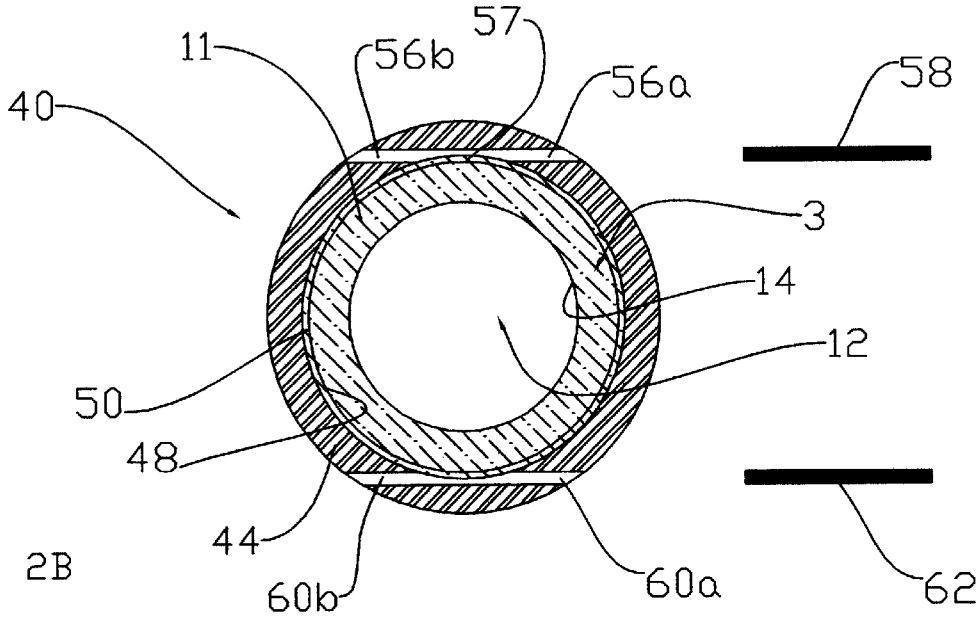
FIG. 2B is a top plan view of the flange of FIG. 2A disposed about the sleeve.

FIG. 2B depicts a top view of the flange 40 disposed about the upper sleeve 3. As seen in FIG. 2B, the shear pin 58 will cooperate with the passage 56 and the groove 57 within the outer sleeve 3 (also seen in FIG. 2C). The shear pin 62 will cooperate with the passage 60 and the groove 63 (also seen in FIG. 2C) within the outer sleeve 3. Note that passage 56 effectively forms two passages 56*a*, 56*b* since the passage is disposed off-centered. Additionally, passage 60 effectively forms two passages 60*a*, 60*b* since this passage is also disposed off-centered. Hence, the shear pin 58 is disposed through passage 56*a*, 56*b*. The shear pin 62 is disposed through passages 60*a*, 60*b*.

Figure 2C:
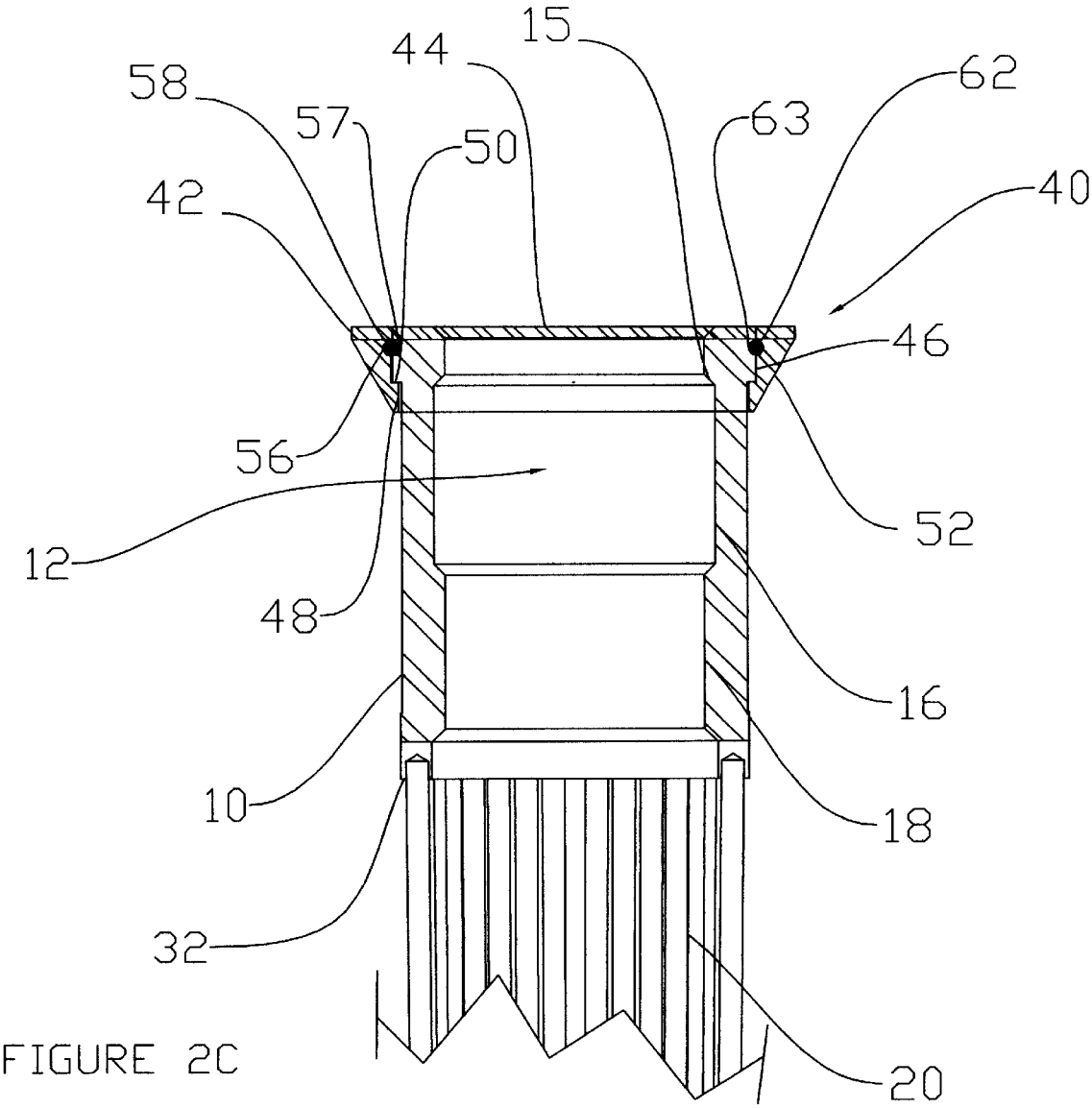
FIG. 2C is a cross-sectional plan view of the flange pinned to the sleeve.

As seen in FIG. 2C, when the flange 40 is pinned into place with the upper sleeve 3, the flow proceeds down the internal bore 12. Note that with the pinned flange 40, there is no internal exposed bore hole to flow. In prior art designs, the flange is pinned radially, thereby having boreholes open to the internal bore, and in turn, exposed to flow through the internal bore 12. Due to turbulent flow of the fluid and debris contained therein, exposed bore holes in the internal bore 12 may lead to erosion and cutting away of metal, which in turn could lead to failure of the pins 58, 60 connecting the flange 40 to the upper sleeve 30. The present invention solves that problem by not having any exposed bore holes in the internal bore, and instead has two passages (56, 60) bored off-centered.

Figure 3:
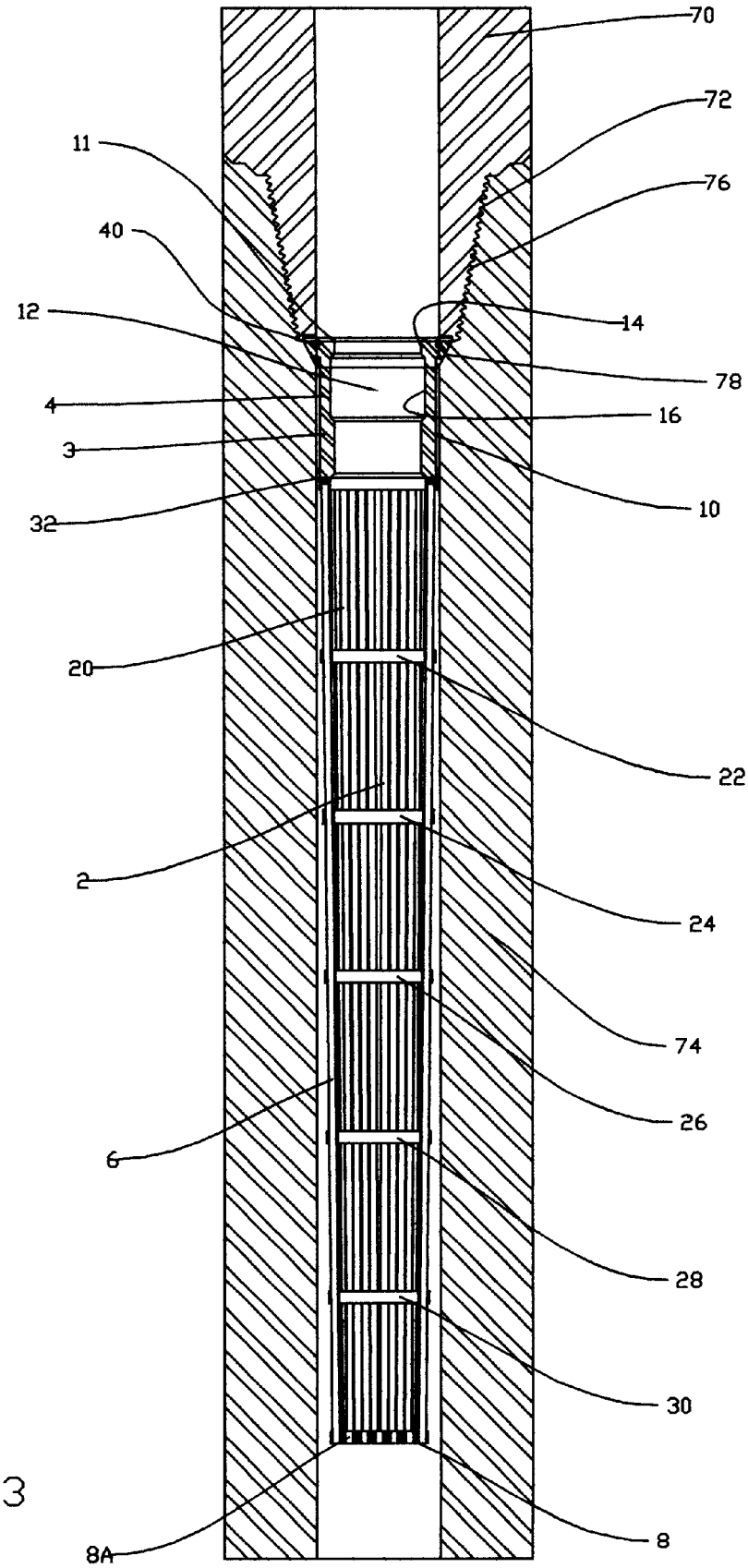
FIG. 3 is a cross-sectional plan view of the screen seated within a tubular string.

A cross-sectional plan view of the screen 2 seated within a tubular string will now be described with reference to FIG. 3. A first tubular member 70 is shown, with the tubular member 70 having external threads 72, referred to as pin end 72. A second tubular member 74 is shown, with the tubular member 74 having internal threads 76, referred to as box end 76. As is well understood by those of ordinary skill in the art, the first tubular member 70 is threadedly connected to the second tubular member 74. Once the tubulars are connected, a cavity 78 is formed between the pin end 72 and box end 76. As seen in FIG. 3, the flange 40 is seated within the cavity 78. Thus, as fluid is flowed through the screen 2, the rods 20 which form the walls of the screen 2 as well as the openings 8A of the base 8, will capture the particles to large to fit there through.

Figure 4:
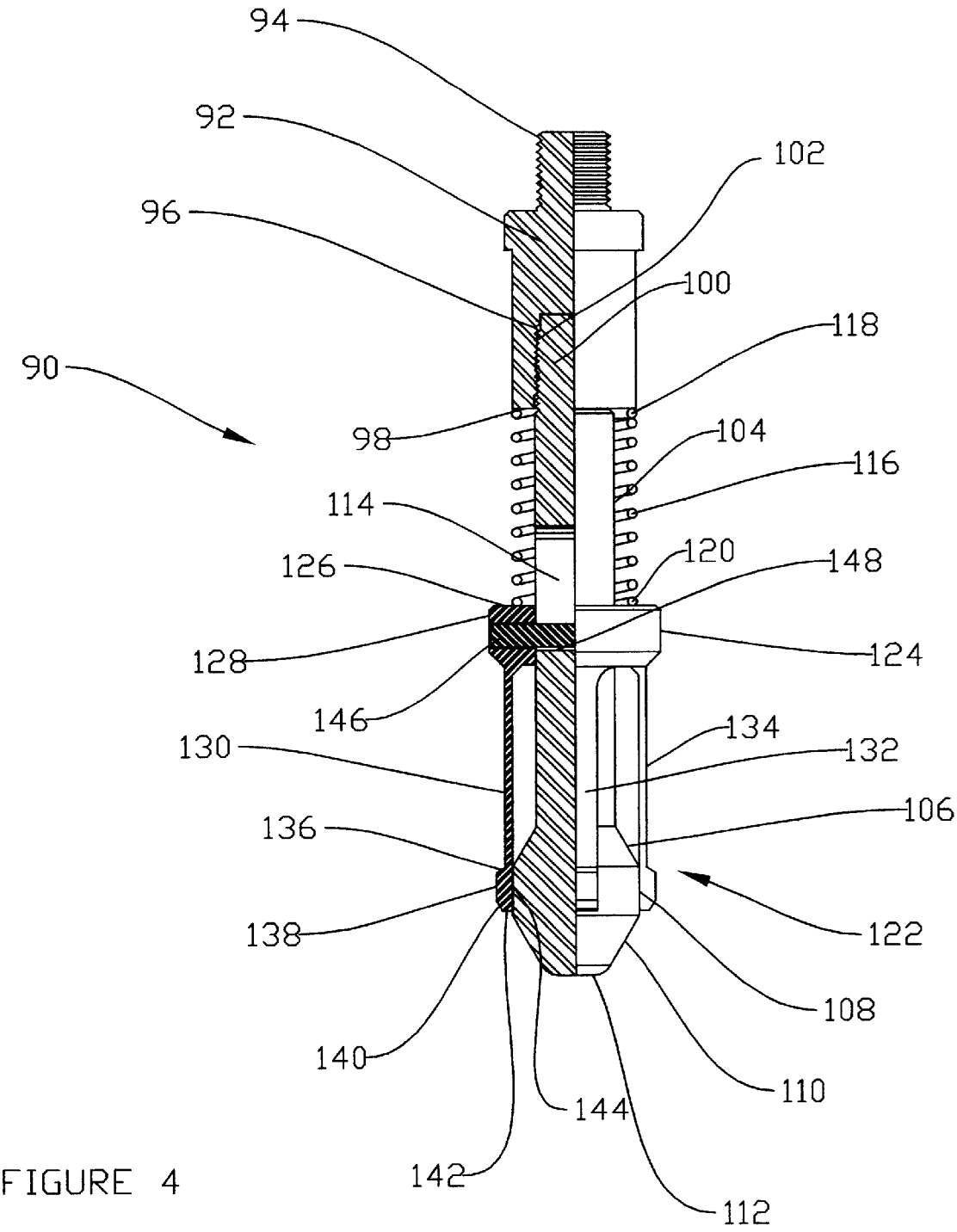
FIG. 4 is a partial cross-sectional plan view of the pulling tool of the present invention.

Referring now to FIG. 4, the pulling tool 90 of the present invention will now be described. The pulling tool 90 comprises a mandrel having a first section 92 that has external threads 94 and internal threads 96. The first section 92 has a radial shoulder 98. A second section 100 of the mandrel has external threads 102 that threadedly connects with the internal threads 96. The second section 98 has an outer cylindrical surface 104 that extends to the angled surface 106 which in turn extends to the generally cylindrical surface 108. The generally cylindrical surface 108 then extends to the angled surface 110 and concludes at the generally radially flat surface 112. The surfaces 106, 108 and 110 define a protuberance at the end of the mandrel. The second section 100 has a slot 114 milled there through.

A spring 116 is disposed about the second section 100 of the mandrel. A first end 118 of the spring 116 is biased against the shoulder 98, and a second end 120 of the spring 116 is biased against the dog member, with the dog member seen generally at 122. The dog member 122 comprises a collar 124 that has a radially flat surface 126 that extends to the outer cylindrical surface 128 which in turn stretches to the plurality of dog legs, which in the preferred embodiments, there are contained four dog legs, three of which are seen in FIG. 4, namely 130. 132, 134. The dogs are elongated having one end extending from the collar 124 and a second end having a protuberance thereon. More specifically, the second end of the dog 130 contains a first angled surface 136 that extends to the longitudinal surface 138 and then angled surface 140 which in turn extends to the radial surface 142. The back side 144 of the dog is positioned next to the surface 108. Each end of the other dogs are similar, and therefore, only the end of dog 130 will be described. A shear pin 146 is disposed through the collar 124, with the shear pin 146 cooperating with the bottom surface 148 of the slot 114 for releasing from the fishing neck in those cases where it is not possible to retrieve the screen 2 with the pulling tool due to some problem, as will be appreciated by those skilled in the art.

Figure 5:
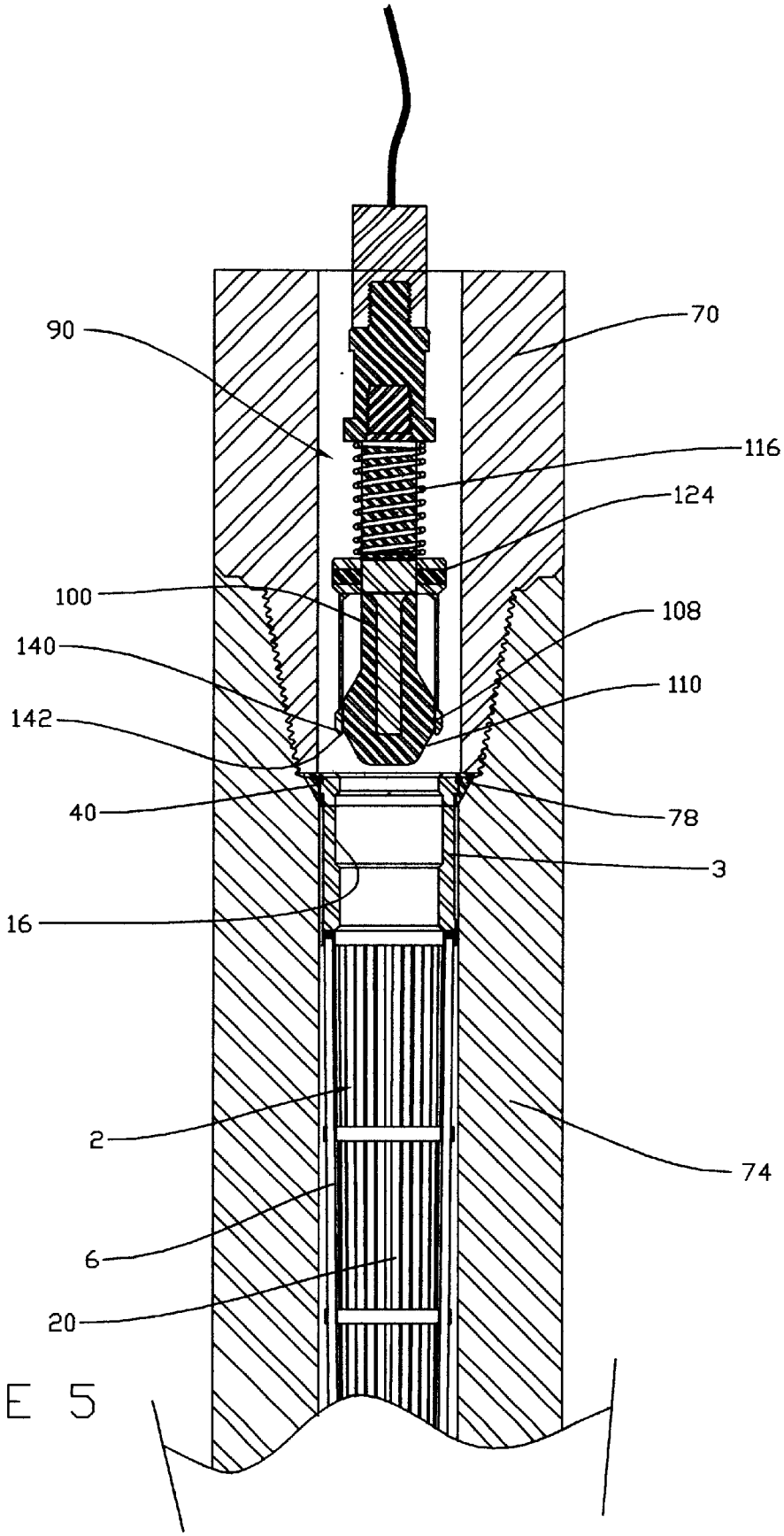
FIG. 5 is a schematic view of the pulling tool approaching the apparatus within a tubular string.

FIGS. 5, 6, 7 and 8 show a sequence of the pulling tool 90 being positioned within the tubular members to retrieve the screen 2. FIG. 5 is a schematic view of the pulling tool 90 approaching the screen 2 within the tubular string. Thus, the upper sleeve 3 is pinned to the flange 40, and the flange 40 is seated within the cavity 78. The pulling tool 90 is lowered via wireline, as is well understood by those of ordinary skill in the art. As shown in FIG. 5, the spring 116 has fully extended the dog members.

Figure 6:
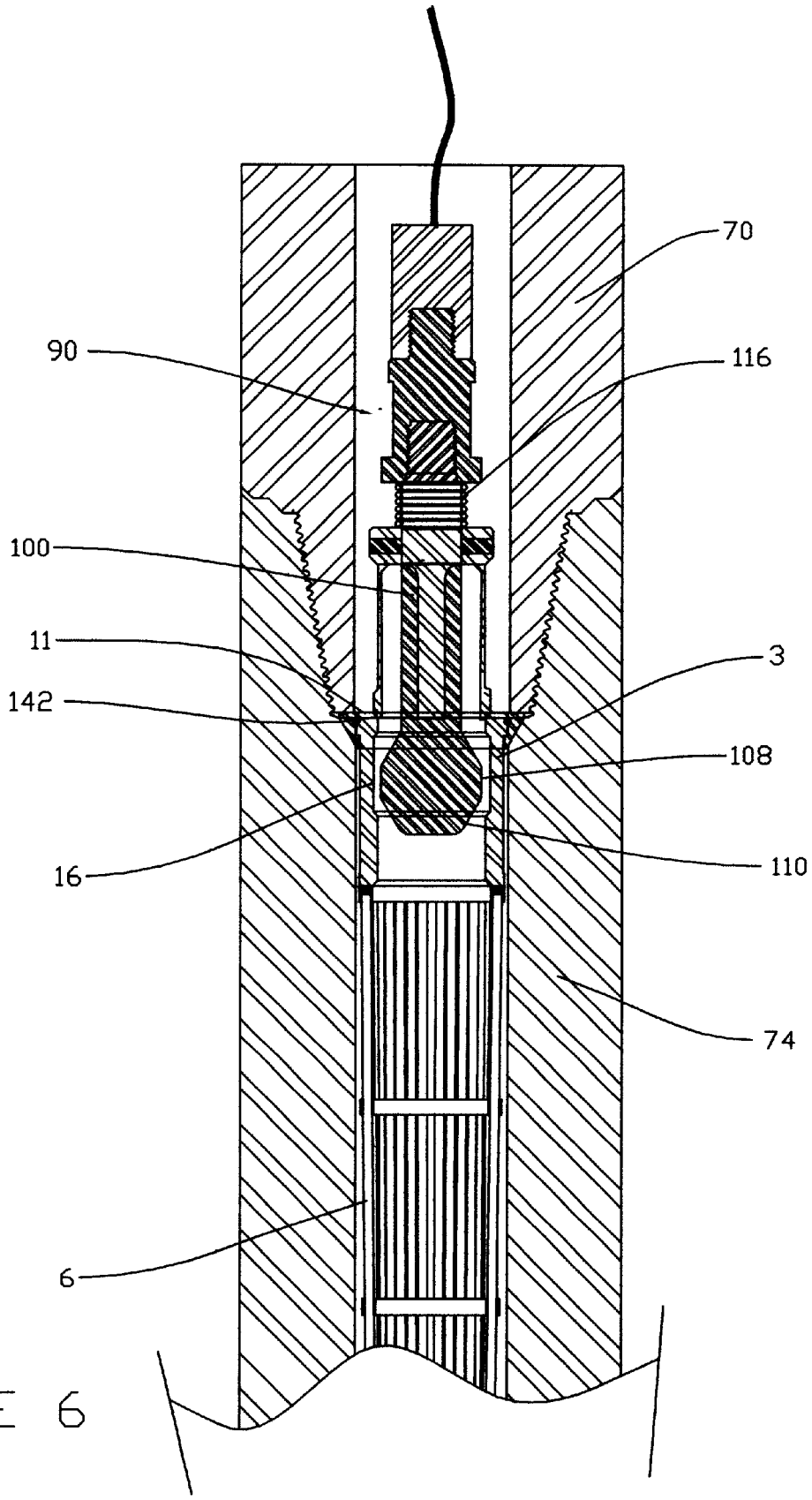
FIG. 6 is the schematic sequence view of FIG. 5 depicting the dogs of the pulling tool being pushed up mandrel.

Next, the pulling tool 90 is lowered further, as seen in FIG. 6. The dogs of the pulling tool are pushed upward relative to mandrel 100. As seen in FIG. 6, the radial surface 142 of the dog members will abut the top radial surface 11 of the sleeve 3 which causes the dogs to move upward which in turn compresses the spring 116. By the dogs moving upward, the protuberance, and in particular, the surfaces 110, 108 can be lowered into the fishing neck portion/internal bore 16.

Figure 7:
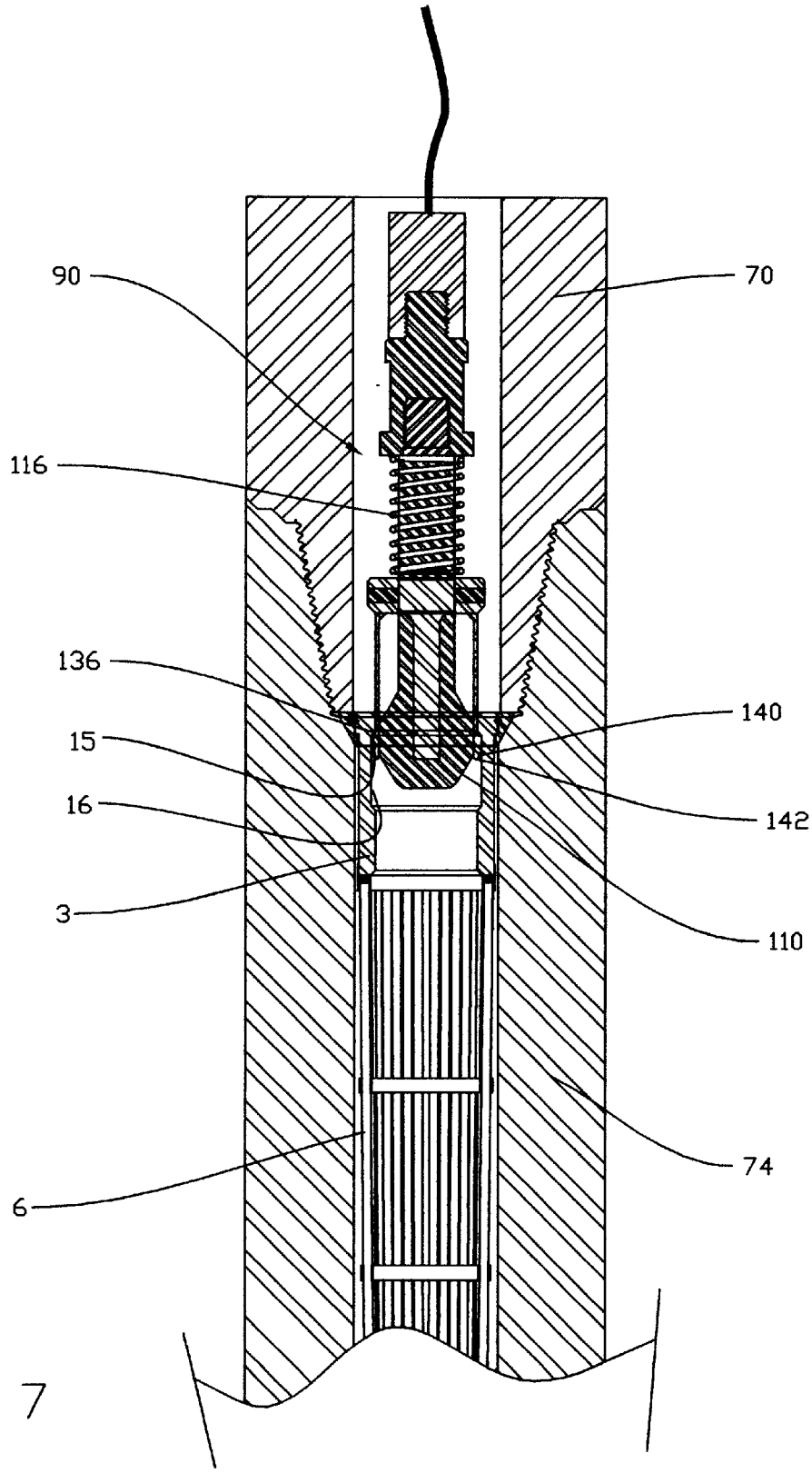
FIG. 7 is the schematic sequence view of FIG. 6 depicting the dogs engaged in fishing neck.
Figure 8:
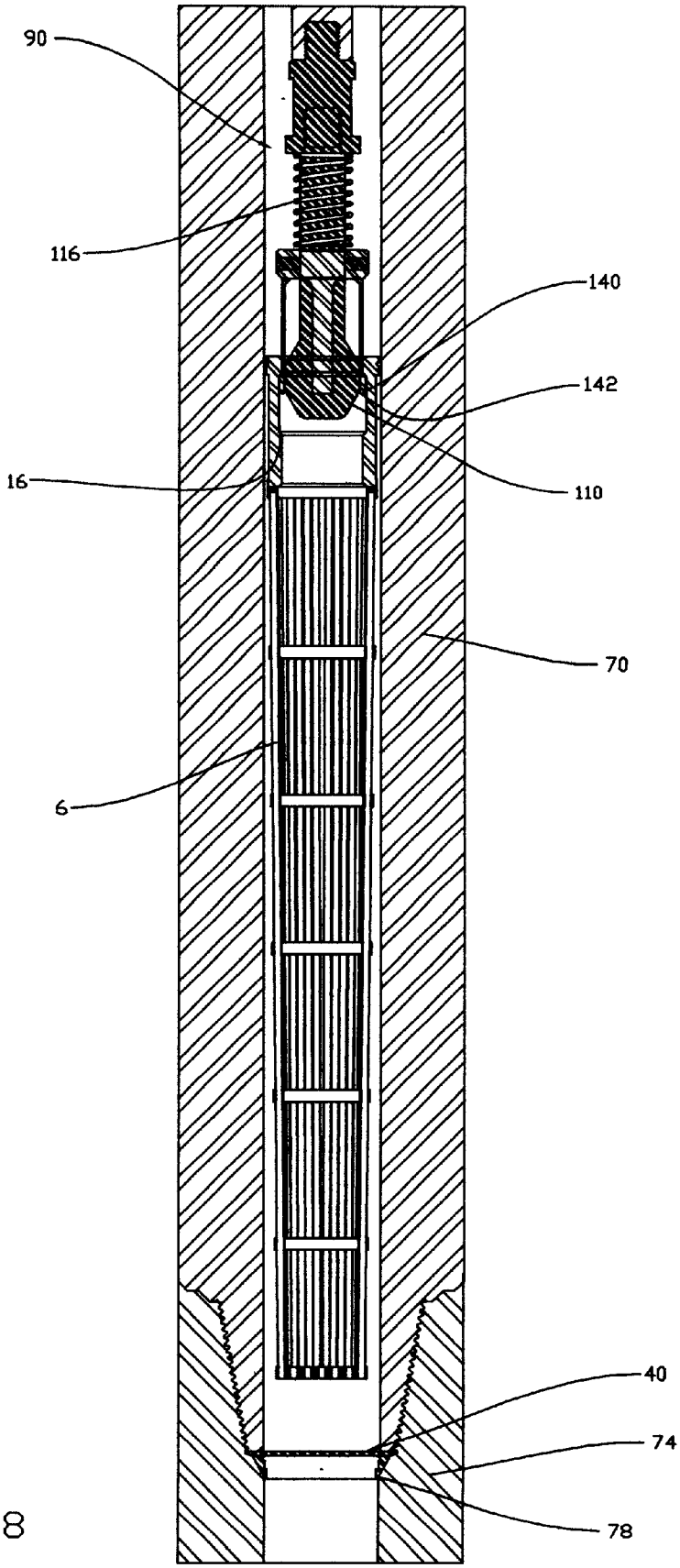
FIG. 8 is the schematic sequence view of FIG. 7 depicting shear pins of the flange having been sheared.

FIG. 7 is the next sequential view depicting the dogs engaged in fishing neck 16, and more particularly, with the angled surface 136 engaging the shoulder 15 of the internal bore 16. Thus, the operator would exert a pull on the wireline and that upward force is transmitted to the pulling tool 90 and in turn to the dogs. The continued exertion of force over a set amount will result in the shearing of the shear pins 58, 62 that held the flange 40 to the sleeve 3 (note the shear pins feature is seen in FIGS. 2A, 2B and 2C). Once the shear pins shear off the flange 40, the operator may pull out of the tubular members as seen in FIG. 8, which allows for retrieval of the screen 2. The flange member 40 is left secured in place within the cavity 78.

If the shear pins 58, 62 of the flange 40 do not shear for some reason, the shear pin 146 disposed through the collar 124 will shear so that the pulling tool can be retrieved from the tubular members. The shear pin 146 is sheared through application of an upward force of the bottom surface 148 of slot 114. Once sheared, the spring 116 extends the dogs fully along past the protuberance, which allows the dogs to collapse so that the pulling tool can be pulled from the tubular as is well understood by those of ordinary skill in the art.

Figure 9:
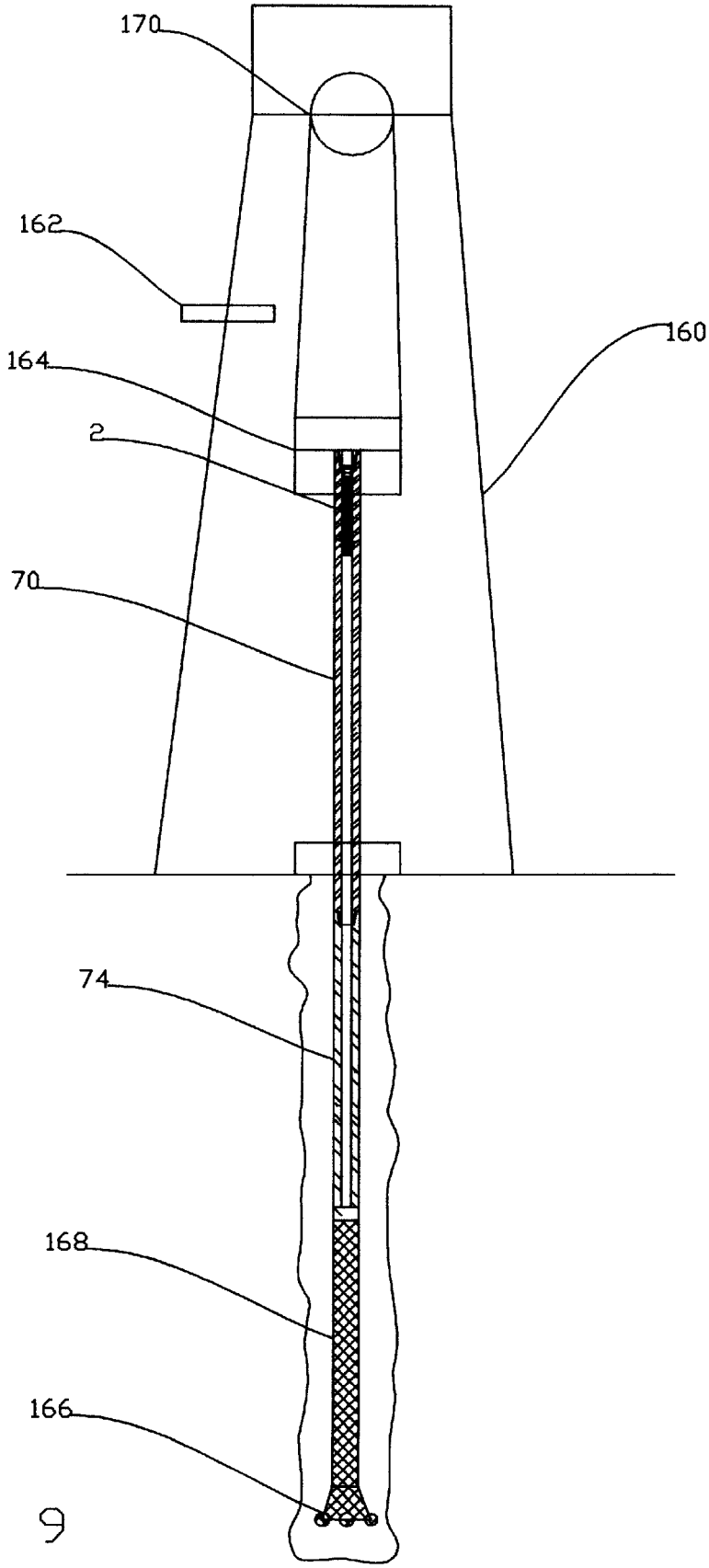
FIG. 9 is a schematic view of a derrick in place over a tubular string disposed within a well bore.
Figure 10:
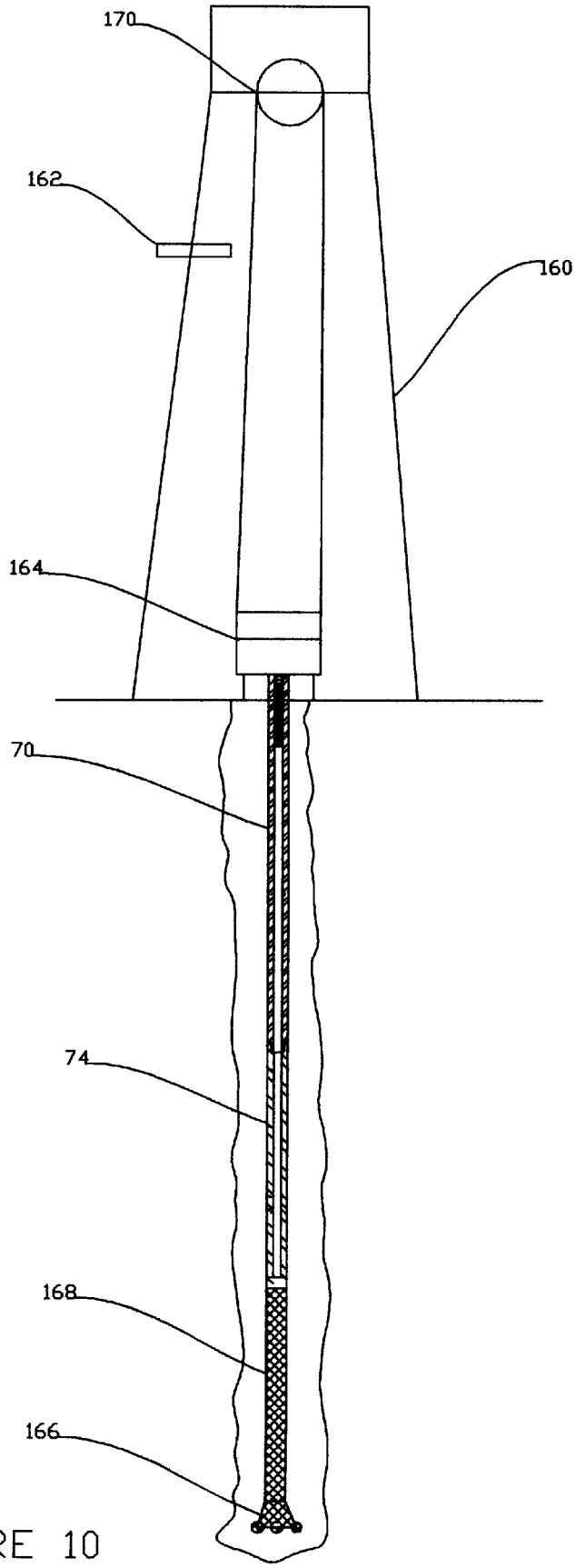
FIG. 10 is the schematic sequence view of FIG. 9 depicting the tubular string being lowered into the well bore.
Figure 11:
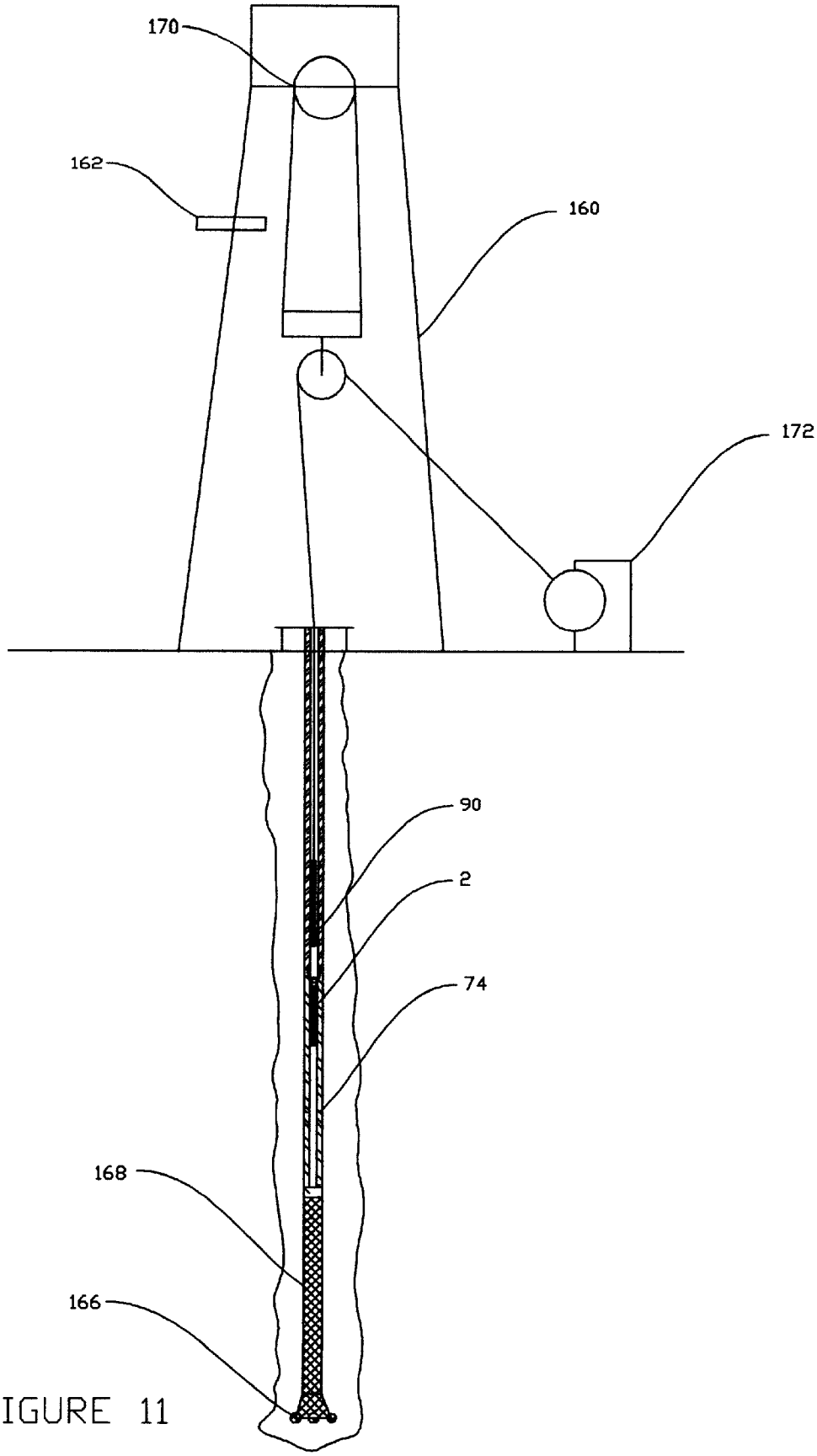
FIG. 11 is the schematic sequence view of FIG. 10 depicting retrieval of the screen with the pulling tool of the present invention.

The FIGS. 9, 10 and 11 show the sequence of placement of the screen 2, and retrieval of the screen 2. More particularly, FIG. 9 depicts a derrick 160 in place over a tubular string disposed within a well bore. The screen 2 with the pinned flange 40 may be placed within the box end of a tubular member by a worker located in the monkey bars 162 of the derrick 160. The kelly or top drive, seen generally at 164, will be operatively attached to the tubular members so that the drilling of a bore hole with the drilling bit 166 may proceed, as will be readily understood by those of ordinary skill in the art. Associated with the drilling bit 166 will be a bottom hole assembly 168. The bottom hole assembly may contain electrical and microprocessor components embedded within tools such as measurement while drilling assemblies.

As noted earlier, the screen 2 will filter out certain sized debris from the fluid. The worker will place the screen 2 within the seat of the box end of the tubing. The top drive 164 and tubing 74 is lowered by the draw works 170, as is well understood by those of ordinary skill in the art.

Referring now to FIG. 10, the schematic sequence view of FIG. 9 depicting the tubular string being lowered into the well bore will now be described. In the normal course of drilling, the operator will have the option of retrieving the screen 2 from the rig floor before coupling the tubular to another tubular joint. In other words, before the drilling tubular is threadedly mated to a second joint of drilling tubular, the operator on the rig floor can simply retrieve the screen 2. If it is desired to keep the screen 2 within the drilling tubular, the second joint of drilling tubular is threadedly connected and therefore, the screen 2 with flange is held in place within the cavity 78 formed from the mating of the box end with the pin end, as previously described.

Once the drilling tubulars are lowered into the well bore as seen in FIG. 11, the screen can no longer be removed by hand since the drilling tubulars are now threadedly coupled together. When it is desired to retrieve the screen 2, a wire line unit 172, as seen in FIG. 11, is rigged up by the operator in order to retrieve the screen 2 with the pulling tool 90 of the present invention. The pulling tool 90 would latch onto the fishing neck 16 of the screen 2 as previously described with reference to FIGS. 5, 6, and 7. The screen 2 would then be pulled from the drilling tubulars as seen in FIG. 11. It should also be noted that FIG. 8 depicts the pulling tool 90 latched and pulling the screen 2 from the tubulars.

Figure 12:
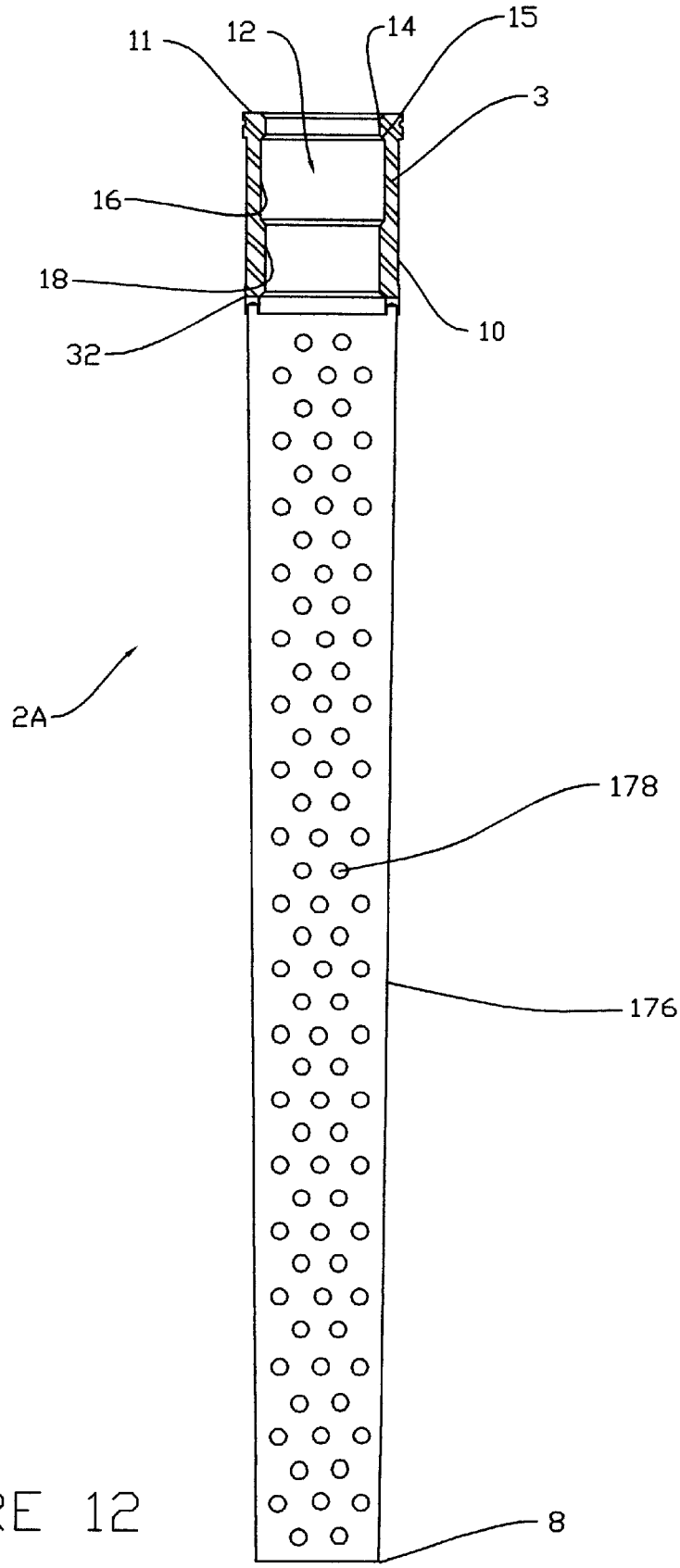
FIG. 12 is a plan view of a second embodiment of the screen member.

FIG. 12 depicts a second embodiment of the screen member 2A. More particularly, the screen member 2A has perforated type of openings rather than the rod elements seen in FIG. 2. The upper sleeve 3 may be attached to the screen member via welding, with the fluid being directed through the internal bore 12 and into the generally cylindrical body 176, wherein cylindrical body 176 contains the openings, and wherein an opening is denoted by the numeral 178. Other types of screens are available such as wire mesh and radially oriented ribs encircling the cylindrical body.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of this invention.

I claim:

1. An apparatus for filtering a drilling fluid comprising:

a cylindrical flange member, said cylindrical flange member having a first passage and a second passage;

a cylindrical sleeve having an internal bore, and wherein said internal bore contains a fishing neck and wherein said cylindrical sleeve contains a first opened end and a second opened end;

means for attaching said cylindrical flange member to said cylindrical sleeve;

a screen member attached at said second opened end of said cylindrical sleeve, said screen member having a cylindrical body, said cylindrical body having a plurality of restricted openings.

2. The apparatus of claim 1 wherein said first passage and said second passage are disposed off-centered so that said first passage includes a first bore hole and a second bore hole, and said second passage includes a third bore hole and a fourth bore hole and wherein the attaching means comprises a first shear pin through said first and second bore hole and a second shear pin through said third and fourth bore hole.

3. The apparatus of claim 2 wherein the first shear pin and the second shear pin cooperates with a groove formed on an outer diameter surface of said cylindrical sleeve.

4. The apparatus of claim 3 further comprising:

a pulling tool, said pulling tool having a mandrel with a first end and a second end; a plurality of dog members disposed about said mandrel; a spring urging said dog members into engagement with the mandrel's first end; and wherein said dog members have a shoulder that cooperates and engages with said fishing neck of said cylindrical sleeve.

5. The apparatus of claim 4 wherein said pulling tool further comprises:

a third shear pin attaching said dog members to said mandrel;

and wherein said mandrel contains a slot, and wherein said third shear pin is disposed within said slot so that said dog members can move axially relative to said mandrel.

6. The apparatus of claim 5 wherein said screen member is a cylindrical ribbed body that has an opened end connected to said cylindrical sleeve and a closed end having openings therethrough.

7. The apparatus of claim 5 wherein said screen member is a cylindrical body with openings therein and wherein said cylindrical body has an opened end connected to said cylindrical sleeve.

8. A system for filtering a drilling fluid in a tubular string comprising:

a first tubular member having a box end and a second tubular member having a pin end, wherein said box end is threadedly connected to said pin end, and wherein said threadedly connected box end and pin end form a cavity and wherein said first tubular member and said second tubular member have an internal bore;

a cylindrical flange member, said cylindrical flange member having a first passage and a second passage, and wherein said cylindrical flange member is fitted into said cavity;

a cylindrical sleeve having an internal bore, and wherein said internal bore contains a fishing neck, said cylindrical sleeve having a first opened end and a second opened end;

an attachment member attaching said cylindrical flange member to said first opened end of said cylindrical sleeve;

a screen member extending from said second opened end of said cylindrical sleeve, said screen member having a plurality of openings;

a pulling tool for engagement with said fishing neck, said pulling tool having a mandrel with a first end and a second end; a plurality of dog members disposed about said mandrel; a spring urging said dog members into engagement with the mandrel's first end; and wherein said dog members have a shoulder that cooperates and engages with said fishing neck of said cylindrical sleeve.

9. The system of claim 8 wherein said first passage and said second passage are disposed offset from center so that said first passage includes a first bore hole and a second bore hole, and said second passage includes a third bore hole and a fourth bore hole and said attachment member includes a first shear pin disposed through said first bore hole and said second bore hole and a second shear pin disposed through said third bore hole and said fourth bore hole, and wherein the first shear pin cooperates with a groove formed on an outer diameter surface of said cylindrical sleeve and wherein the second shear pin cooperates with said groove.

10. The system of claim 9 wherein said cylindrical flange member has a first seating surface that cooperates with said cavity in order to seat said cylindrical flange member relative to said internal bore.

11. The system of claim 10 wherein said pulling tool further comprises:

a third shear pin attaching said dog members to said mandrel;

and wherein said mandrel contains a slot, and wherein said third shear pin is disposed within said slot so that said dog members can move axially relative to said mandrel.

12. The system of claim 11 wherein said screen member is a cylindrical ribbed body.

13. The system of claim 11 wherein said screen member is a cylindrical body with openings therein.

14. A method of cleaning a drilling fluid of debris comprising:

providing a plurality of tubular members, wherein said plurality of tubular members are threadedly connected, and wherein said plurality of tubular members include a first tubular member having a box end and a second tubular member having a pin end, wherein said box end is threadedly connected to said pin end, and wherein said box end and pin end form a cavity;

placing a screen apparatus within said first tubular member, said screen apparatus comprising: a cylindrical flange member, said cylindrical flange member having a first passage and a second passage, and wherein said cylindrical flange member is configured to fit into said cavity; a cylindrical sleeve attached to said cylindrical flange having a first shear pin in said first passage and a second shear pin in said second passage, said cylindrical sleeve having an internal bore, and wherein said internal bore contains a fishing neck, and a screen member attached to said cylindrical sleeve;

seating said cylindrical flange member within said cavity;

passing the drilling fluid through said internal bore;

flowing the drilling fluid through said screen member;

collecting the debris within said screen member.

15. The method of claim 14 further comprising:

providing a pulling tool, said pulling tool having a mandrel with a first end and a second end; a plurality of dog members disposed about said mandrel; a spring urging said dog members into engagement with the mandrel's first end; and wherein said dog members have a shoulder that cooperates and engages with said fishing neck of said cylindrical sleeve;

lowering the pulling tool into the first tubular member on a wire line;

contacting said dog members with the fishing neck;

allowing said dog members to contract about said mandrel;

passing a protuberance formed on the mandrel pass the fishing neck;

lowering said pulling tool on the wire line;

allowing the shoulder of said dog members to engage said fishing neck;

raising the pulling tool with the wire line.

16. The method of claim 15 further comprising:

shearing the first shear pin and the second shear pin;

releasing the cylindrical sleeve from the cylindrical flange.

17. The method of claim 16 further comprising:

pulling said pulling tool with attached cylindrical sleeve and screen member from the first tubular member and the second tubular member.

18. The method of claim 17 further comprising:

pulling the first tubular member and the second tubular member from the well bore;

threadedly disconnecting the first tubular member from the second tubular member;

retrieving said cylindrical flange.

19. The method of claim 18 wherein said screen member is a plurality of longitudinally ribbed screen elements.

20. The method of claim 18 wherein said screen member is a cylindrical body with openings therein.

* * * * *